US007987878B1

(12) United States Patent
Imler

(10) Patent No.: US 7,987,878 B1
(45) Date of Patent: Aug. 2, 2011

(54) VAPOR RECOVERY FUEL DISPENSING NOZZLE

(75) Inventor: David L. Imler, Tipp City, OH (US)

(73) Assignee: Catlow, Inc., Tipp City, OH (US)

( * ) Notice: Subject to any disclaimer, the term of this patent is extended or adjusted under 35 U.S.C. 154(b) by 986 days.

(21) Appl. No.: 11/901,850

(22) Filed: Sep. 19, 2007

(51) Int. Cl.
*B65B 31/00* (2006.01)

(52) U.S. Cl. ..... 141/59; 141/206; 141/208; 141/215; 141/292; 141/295; 141/302

(58) Field of Classification Search ..... 141/59, 141/206, 208, 215, 285, 290, 291, 292, 301, 141/302, 308; 285/261
See application file for complete search history.

(56) References Cited

U.S. PATENT DOCUMENTS 4,071,059 A * 1/1978 Hansel ..... 141/206
4,697,624 A 10/1987 Bower et al.
5,255,723 A 10/1993 Carmack et al.
5,655,576 A 8/1997 Leininger et al.
5,775,384 A * 7/1998 Alvern ..... 141/59
6,851,628 B1 * 2/2005 Garrison et al. ..... 239/525
6,951,229 B2 10/2005 Garrison et al.
7,082,972 B1 8/2006 Healy
7,134,580 B2 * 11/2006 Garrison et al. ..... 222/566
2005/0076970 A1 * 4/2005 Garrison et al. ..... 141/206

* cited by examiner

*Primary Examiner* — Gregory L Huson
*Assistant Examiner* — Jason K Niesz
(74) *Attorney, Agent, or Firm* — Jacox, Meckstroth & Jenkins

(57) ABSTRACT

A fuel dispensing nozzle has a body defining a fuel supply passage and a vapor return passage each having a control valve operated by a hand actuated lever pivotally connected to an axially movable tubular member retained by a diaphragm actuated clutch. A fuel spout extends from the body and is surrounded by an annular plastic socket assembly to define therebetween a vapor return passage. The socket assembly includes a first socket member supporting an annular vapor seal for engaging a fuel tank fill tube. The first socket member is supported for universal free tilting movement by a second socket member supported by the body for axial movement. The second socket member supports a pin connected to a crank arm for blocking operation of the clutch, and an annular flexible cover surrounds the socket assembly to protect the socket members which provide unrestricted flow of fuel vapors.

15 Claims, 2 Drawing Sheets

VAPOR RECOVERY FUEL DISPENSING NOZZLE

BACKGROUND OF THE INVENTION

This invention relates to a vapor recovery fuel dispensing nozzle of the balanced-type, for example, as disclosed in U.S. Pat. No. 5,255,723 ('723 patent) which issued to the assignee of the present invention and the disclosure of which is herein incorporated by reference. Other forms of vapor recovery fuel dispensing nozzles of the balanced-type where fuel vapors are displaced from the vehicle fuel tank back into the underground tank, are disclosed in U.S. Pat. No. 4,697,624, No. 5,655,576, No. 6,951,229, and No. 7,082,972. In such a fuel dispensing nozzle assembly, a collapsible corrugated rubber bellows surrounds a fuel supply spout and defines therebetween a vapor return passage connected to a vapor return passage within the nozzle body and within a co-axial fuel supply hose. When a nozzle spout is inserted into a fuel fill tube or pipe projecting from a fuel tank of a motor vehicle, an annular vapor seal carried by the bellows engages the lip of the fill pipe. As the bellows is axially compressed by further pressure on the nozzle, a valve within the vapor passage opens. Axial compression of the bellows is also effective to actuate a diaphragm operated ball clutch which locks an axially movable stem to the nozzle body to form a fixed pivot support for a hand actuated lever connected to control a valve within the fuel supply passage.

When the annular resilient vapor seal engages the fuel fill pipe, it is desirable to obtain and maintain a positive and uniform annular pressure seal between the annular resilient vapor seal and the fill pipe to assure that fuel vapors displaced in the fuel tank transfer into the vapor return passage within the nozzle. It is also desirable to minimize the resistance to the flow of vapors into and through the fuel dispensing nozzle and into the vapor passage within the co-axial hose connecting the nozzle to the fuel dispenser since there is commonly no suction on the vapor return passage. It has been found that a collapsible bellows produces resistance to the vapor flow and sometimes does not produce a uniform pressure seal around the fuel tank fill pipe.

SUMMARY OF THE INVENTION

The present invention is directed to an improved vapor recovery fuel dispensing nozzle of the balanced type and which provides the desirable features of assuring a full annular and uniform pressure seal between the resilient vapor seal on the nozzle and the fuel tank fill pipe while filling the fuel tank and also minimizes the resistance to flow of vapor into the nozzle body. In accordance with the illustrated embodiment of the invention, the nozzle body has a fuel supply passage and a vapor return passage and supports a projecting fuel supply spout forming an extension of the fuel supply passage within the nozzle. A swivel knuckle or socket assembly surrounds the fuel supply spout and cooperates with the spout to define a smooth vapor return passage connected to the vapor return passage within the nozzle body. The socket assembly includes a substantially rigid annular first socket member supporting a resilient annular vapor seal adapted to engage the fill tube, and a substantially rigid annular second socket member is supported by the nozzle body for axial movement. The first and second socket members have mating and sliding part-spherical surfaces providing for universal tilting movement between the socket members while maintaining a vapor return passage within the socket members.

The socket members have smooth inner surfaces which minimize the resistance to the return flow of fuel vapors.

Other features and advantages of the invention will be apparent from the following description, the accompanying drawings and the appended claims.

DESCRIPTION OF THE PREFERRED EMBODIMENT

Figure 1:
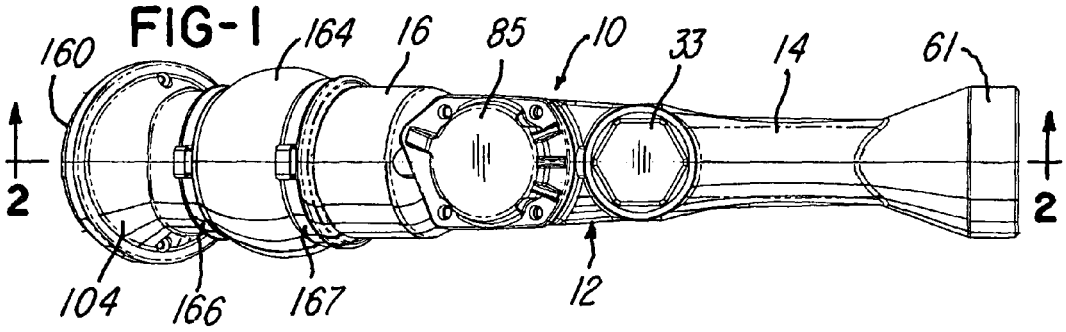
FIG. 1 is a top view of a fuel dispensing nozzle assembly constructed in accordance with the invention.
Figure 2:
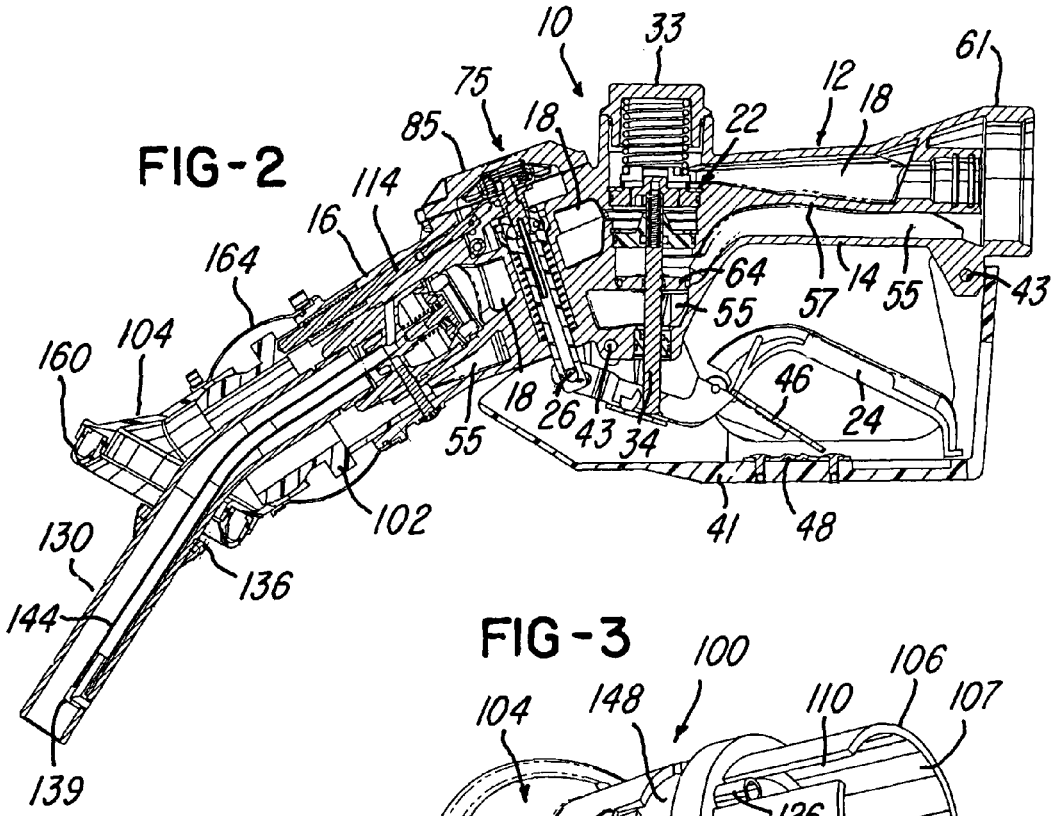
FIG. 2 is a section through the nozzle, taken generally on the line 2-2 of FIG. 1.

FIGS. 1 and 2 show a balanced-type vapor recovery fuel dispensing nozzle assembly 10 having a construction similar to the nozzle disclosed in above-mentioned '723 patent and with some common components. Thus in FIGS. 1 & 2, the vapor recovery nozzle assembly 10 includes a cast aluminum body 12 having a tubular handle portion 14 and an annular or cylindrical outlet portion 16. The body 12 defines internal fuel supply passage 18, and a fuel flow control valve 22 controls the flow of fuel through the passage 18 in response to pivoting of a manually actuated control lever 24 about a pivot pin 26. The control valve 22 includes a valve member 28 (FIG. 4) within an annular seat member 29 and which is normally closed by a compression spring 31, a spring support and a resilient washer confined by a cup-shaped plug 33 threaded into the body 12. A rod or stem 34 extends from the valve member 28 and engages the control lever 24, and a resilient O-ring surrounds the stem 34 and is retained within a plastic guide bushing 38 secured by a retaining ring and sealed to the body by a resilient O-ring. The control lever 24 is enclosed within a plastic lever guard 41 which is secured to the body 12 by a pair of crossed pins 43 (FIG. 2). A spring biased lever 46 is connected to the actuating lever 24, and a plate 48 has a series of ribs for selectively receiving the end of the lever 46, in a conventional manner, when the valve control lever 24 is gripped and moved upwardly to open the fuel valve 22.

The body 12 also defines an internal vapor return passage 55 (FIGS. 2 and 4) which extends partially around a hollow portion 57 defining the fuel passage 18 within the handle portion 14. The vapor passage 55 extends from an enlarged internally threaded inlet portion 61 (FIG. 1) which receives an annular fitting rotatably supported by a tubular sleeve secured to one end of a flexible co-axial fuel supply and vapor return hose, as shown in the '723 patent. The return flow of vapor through the return passage 55 is controlled by a metal or brass circular valve member 64 (FIG. 4) which is mounted on and sealed to the actuating stem 34 and carries an resilient O-ring which normally engages a tapered or frusto-conical seat 66 (FIG. 5) within the valve body. When the rod or stem 34 is moved upwardly in response to pivoting the lever 24, both the fuel flow valve member 28 and the vapor flow valve member 64 move from their closed positions (FIG. 4) to their open positions (FIG. 5) and return to their closed positions when the control lever 24 is returned to its released position (FIGS. 2 & 4).

The forward end portion of the actuating lever 24 is pivotally supported by the lower end portion of a molded plastic tube or tubular member 70 which receives the pivot pin 26. The tubular member 70 is biased upwardly by a compression spring 72, and an enlarged upper end portion of the member 70 is locked to the nozzle body or released from the nozzle body by a ball clutch 74 forming part of an automatic shut-off mechanism 75. As generally disclosed in the above-mentioned patent '723, the mechanism 75 includes a flexible diaphragm 78 secured to a clutch stem 81 which is normally biased downwardly by a compression spring 83 retained within a cap member 85 secured to the nozzle body. A set of balls 87 surround the clutch stem 81 and are normally retained within corresponding holes within the enlarged upper end portion of the tubular member 70 when the diaphragm is in its normal position shown in FIG. 4. When the diaphragm 78 and the clutch stem 81 shift downwardly (FIG. 5), the balls 87 are cammed outwardly by the stem 81 above an annular tapered shoulder within the body to lock the tubular member 70 to the body and thereby fix the pivot pin 26.

Figure 3:
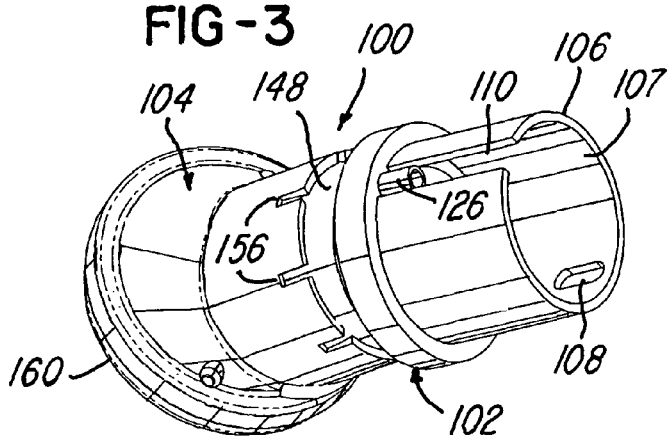
FIG. 3 is a perspective view of the socket assembly shown in section in FIG. 2.
Figure 4:
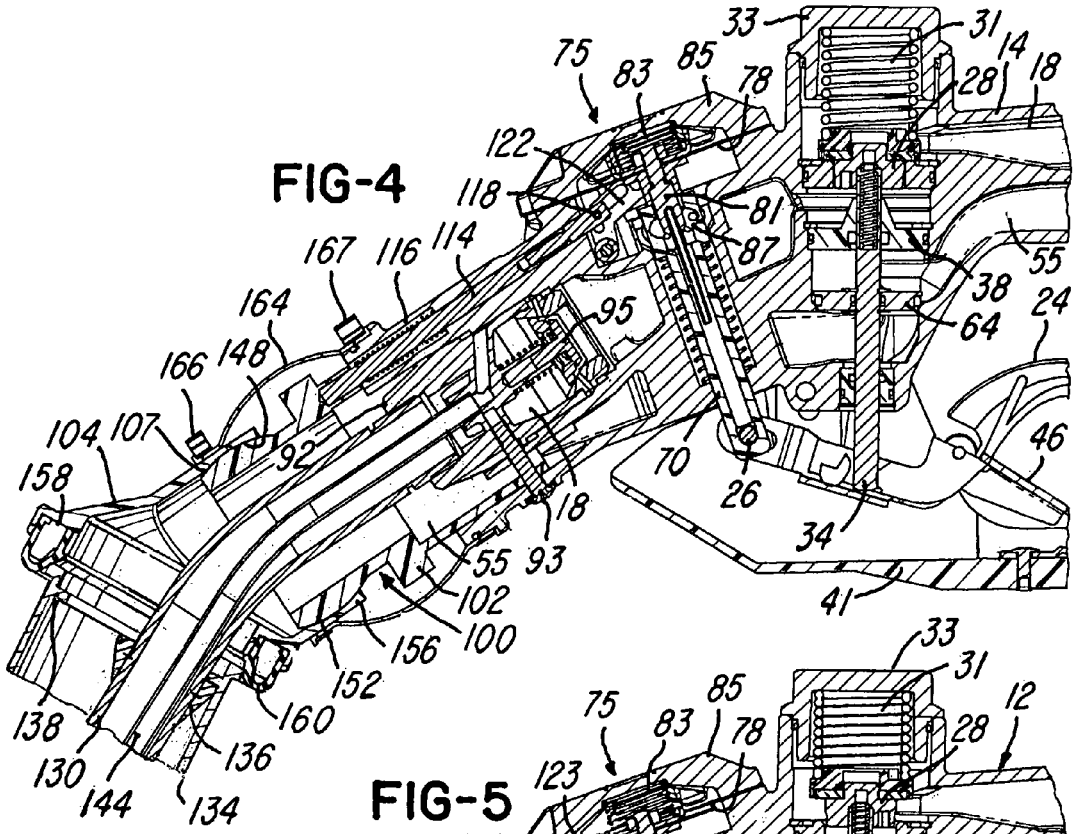
FIG. 4 is an enlarged fragmentary section similar to FIG. 2 and showing the nozzle assembly in initial contact with a fuel tank fill pipe.

As shown in FIG. 4, the forward end portion 16 of the nozzle body receives a fitting 92 which is retained by a screw 93 and supports a spring biased fuel control poppet valve 95 within the fuel supply passage 18. The poppet valve 95 operates in a manner as disclosed in above-mentioned '723 patent. In accordance with the present invention, the forward end portion 16 of the nozzle body also supports an annular swivel knuckle or socket assembly 100 which includes a first socket member 102 and a second socket member 104 each of which is molded of a substantially rigid plastics material such as a material sold under the trademark "Delrin" or "Zytel". The knuckle or socket assembly 100 is shown in perspective in FIG. 3, and the socket member 102 includes a part-cylindrical inner portion 106 which has a smooth inner surface 107 and is supported for axial sliding movement within a mating part-cylindrical bore formed within the forward end portion 16 of the nozzle body.

A slot 108 within the portion 106 receives the retaining screw 93 to limit axial movement of the socket member 102, and a slot 110 receives an inwardly projecting rib 112 of the body portion 16. As shown in FIG. 4, the rib 112 has an axially extending bore which receives an actuating pin 114 for sliding movement between an extended position (FIG. 4) and a retracted position (FIG. 5) against a compression spring 116. The inner end portion of the pin 114 receives a threaded fitting which supports a cross pin 118 extending through an L-shaped or angular slot within a yoke-shaped crank arm 122 supported for pivotal movement by a cross pin 123. The upper or outer end of the crank arm 122 engages a flange member secured to the stem 81 adjacent the bottom of the diaphragm 78 and normally urges the diaphragm in its upper retracted position (FIG. 4) when the actuating pin 114 is extended by the spring 116. In this position, the ball clutch 74 is released and the tubular member 70 is free to shift downwardly against the light force of the compression spring 72. The forward end portion of the pin 114 is received within a tubular socket 126 (FIG. 3) molded as an integral part of the socket member 102 so that the pin moves axially with the socket member 102.

Figure 5:
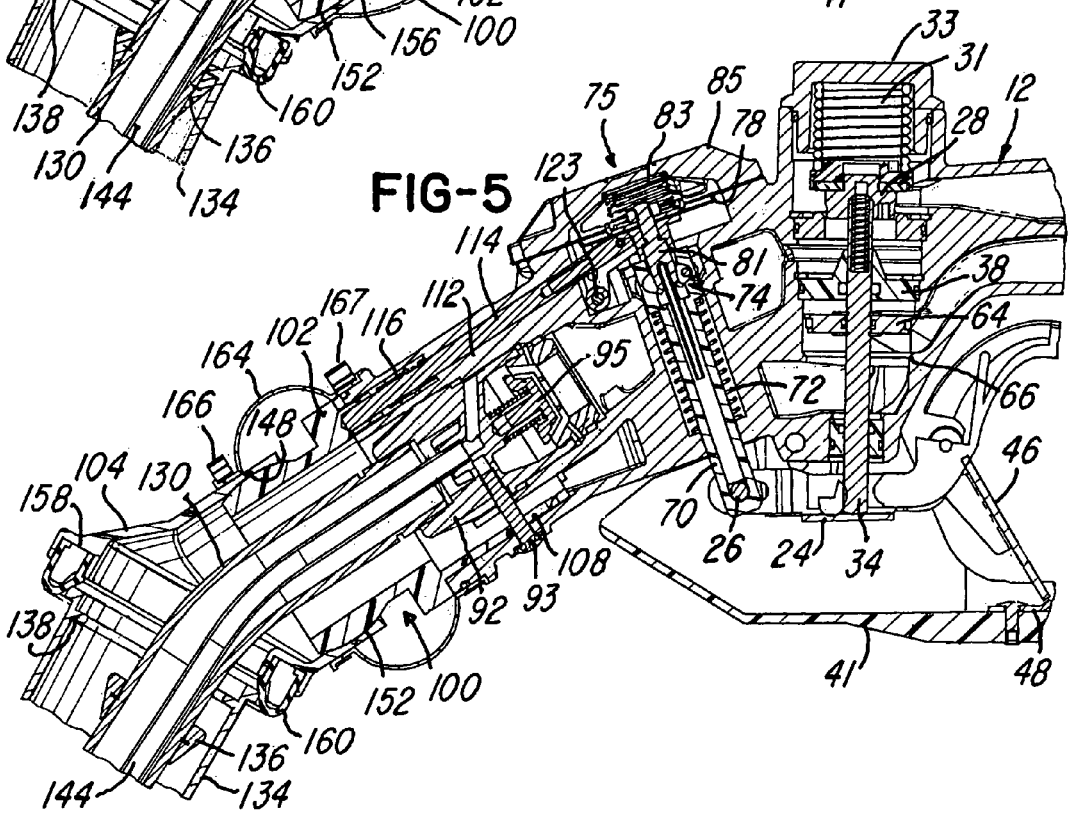
FIG. 5 is an enlarged fragmentary section similar to FIG. 4 and showing the nozzle assembly after it has formed a uniform vapor-tight seal with the fuel tank fill pipe.

As shown in FIGS. 4 & 5, a rigid or metal fuel supply tube or spout 130 has an inner end portion threadably secured to the fitting 92, in a conventional manner, and the outer end portion of the spout 130 is adapted to project into a fuel inlet fill pipe or tube 134 projecting upwardly from a motor vehicle fuel tank. A collar 136 is secured to the spout 130 and is adapted to engage an inwardly projecting annular rib 138 formed on the fill tube 134 to secure the spout 130 to the fill tube and prevent it from sliding outwardly from the fill tube after the spout 130 is initially inserted into the fill tube. As also shown in FIGS. 4 & 5 and in the '723 patent, an overfill shut off air bleed tube 144 extends longitudinally within the spout 130 and has an inner end portion projecting into a bore formed within the fitting 92. The tube 144 has an outer end portion (FIG. 2) connected by an elbow 139 to a radial port within the outer end portion of the spout 130. The function of the bleed tube 144 is the same as described in the '723 patent.

Referring again to FIGS. 3-5, the socket member 102 has a forward end portion with a part-spherical outer surface 148 which receives a mating part-spherical inner surface 152 formed on the inner end portion of the socket member 104 so that the socket member 104 is free to pivot or swivel in a universal manner on the socket member 102. The rearward end portion of the socket member 104 has circumferentially spaced slots 156 (FIG. 3) so that the inner end portion of the socket member 104 will snap-fit onto the outer or forward end portion of the socket member 102. The forward end portion of the socket member 104 is molded with an annular channel 158 which receives a resilient annular vapor seal 160 secured within the channel by a suitable adhesive. The angular position of the channel 158 and the vapor seal 160 are in a plane generally normal to the outer end portion of the fuel spout 130 so that the vapor seal 160 has an axis substantially aligned with the axis of the fuel tank inlet fill tube 134, as shown in FIG. 4. As also shown in FIGS. 4 & 5, an annular flexible resilient cover 164 extends from the rearward end portion of the socket member 104 to the forward end portion of the nozzle body portion 16 and has opposite cylindrical end portions secured by band clamps 166 & 167 to the socket member 104 and body portion 16. The flexible cover 164 prevents dirt and other foreign particles from entering between the mating part-spherical surfaces 148 & 152 and disturbing the seal between the surfaces.

In operation, after the nozzle spout 130 is inserted into the fuel inlet fill tube 134, the vapor seal 160 engages the outer lip or flange portion of the tube 134, as shown in FIG. 4. As further pressure is exerted on the nozzle, the swivel socket assembly 100 shifts inwardly (FIG. 5) so that a tighter fluid-tight seal is formed between the vapor seal 160 and the fill tube 134. The inward movement of the socket member 102 also shifts the actuating pin 114 inwardly to release the crank arm 122 to allow the diaphragm 78 to move downwardly under the pressure of the spring 83 whereby the balls 87 are cammed outwardly to lock the tubular member 70 to the nozzle body. The pivot support pin 26 is then locked in position so that pivoting of the actuating lever 24 is effected to open both the fuel supply valve 28 and the vapor return valve 64 to their open positions, as shown in FIG. 5. When the lever 24 is released so that the valve members return to their closed positions, fuel stops flowing in the passage 18 and return vapor stops flowing in the vapor passage 55. When fuel stops flowing, the air suction on top of the diaphragm 78 stops so that the clutch stem 81 is retracted and the clutch balls shift inwardly to release the lever support pivot pin 26.

It is also apparent that if the fuel supply spout 130 is retracted from the fill tube 134 while fuel is being dispensed, the socket assembly 100 will return to its normal position (FIG. 4), and the outward movement of the actuating pin 114 pivots the crank arm 122 counterclockwise, thereby lifting the diaphragm 78 to release the tubular member 70 and pivot pin 26 so that they drop downwardly to pivot the lever 24, closing the fuel supply valve member 28 and the vapor return valve member 64. As described in the '723 patent, the diaphragm 78 will also return to its normal position to release the tubular member 70 and pivot pin 26 in the event suctioned air in the tube 144 and created by a venturi at the poppet valve 95 is blocked by rising fuel outside the fuel supply spout 130. When the fuel control valve 28 closes, the fuel supply poppet valve 95 returns to its closed position to stop the suction on the diaphragm 78.

From the drawings and the above description, it is apparent that a fuel dispensing nozzle constructed in accordance with the invention provides desirable features and advantages. For example, the smooth inner surfaces of the molded socket members 102 & 104 provide for a smooth unrestricted flow of fuel vapors into the vapor passage 55 within the nozzle body. Thus the socket members avoid the disturbance and restriction to the vapor flow by the conventional corrugated bellows and also avoid the collection of fuel droplets in the corrugations. In addition, the free universal tilting movement between the socket members 102 & 104 provides for a positive and uniform compression of the vapor seal 160 on the end of the fuel fill tube 134 and avoid the non-uniform compression of a flexible bellows that is tilted. The outer part-spherical surface of the socket member 102 may also be provided with an outwardly projecting stud which extends through one of the slots 56, or a wider slot, to limit rotation of the socket member 104 and vapor seal 160 relative to the socket member 102 and nozzle body.

While the form of nozzle assembly herein described constitutes a preferred embodiment of the invention, it is to be understood that the invention is not limited to this precise form of assembly, and that changes may be made therein without departing from the scope and spirit of the invention as defined in the appended claims.

What is claimed is:

1. A dispensing nozzle assembly adapted to be used with a vapor recovery fuel dispensing system including a flexible hose defining a liquid fuel supply passage and a vapor return passage, said nozzle assembly comprising a nozzle body having a fuel supply passage and a vapor return passage, a fuel supply spout extending from said body and forming an extension of said fuel supply passage, a manually actuated fuel control valve within said fuel supply passage, a swivel socket assembly connected to said body and surrounding said fuel supply spout to define therebetween a vapor return passage connected to said vapor return passage within said body, said socket assembly including a substantially rigid annular first socket member supporting an annular resilient sealing member adapted to engage a fuel tank fill tube, a substantially rigid annular second socket member connected to said body and supported for axial movement relative to said body between retracted and extended positions, and said first and second socket members having mating and sliding surfaces providing for universal tilting movement between said socket members while maintaining said vapor return passage within said socket members.

2. A nozzle assembly as defined in claim 1 wherein said mating surfaces comprise a part-spherical outer surface and a part-spherical inner surface receiving said outer surface and providing said universal tilting movement between said socket members.

3. A nozzle assembly as defined in claim 2 wherein said part-spherical inner surface is interrupted by peripherally spaced slots providing a snap-fit connection between said socket members.

4. A nozzle assembly as defined in claim 1 wherein said second socket member has a generally cylindrical and smooth inner surface surrounding said fuel supply spout and defining with said spout an annular said vapor return passage.

5. A nozzle assembly as defined in claim 1 wherein each of said first and second socket members comprises a substantially rigid plastics material and have smooth inner surfaces.

6. A nozzle assembly as defined in claim 1 and including an annular air impervious flexible cover member connecting said first socket member to said nozzle body to prevent the entrance of dirt and other particles between said mating and sliding surfaces.

7. A nozzle assembly as defined in claim 1 and including a diaphragm actuated clutch connected to a pivot support for a hand actuating lever connected to operate said fuel control valve, and an elongated pin connected to move axially with said second socket member and connected to block movement of said clutch when said second socket member is in said extended position.

8. A nozzle assembly as defined in claim 1 and including a vapor control valve within said vapor return passage, said fuel control valve and said vapor control valve each having a corresponding valve member supported by a valve stem for simultaneous movement between corresponding open and closed positions, and a hand actuated lever connected to move said valve stem.

9. A dispensing nozzle assembly adapted to be used with a vapor recovery fuel dispensing system including a flexible hose defining a liquid fuel supply passage and a vapor return passage, said nozzle assembly comprising a nozzle body having a fuel supply passage and a vapor return passage, a fuel supply spout extending from said body and forming an extension of said fuel supply passage, a manually actuated fuel control valve within said fuel supply passage and actuated by a valve stem connected to a control lever, a vapor control valve within said vapor return passage and including a valve member mounted on said valve stem, a swivel socket assembly connected to said body and surrounding said fuel supply spout to define therebetween a vapor return passage connected to said vapor return passage within said body, said socket assembly including a substantially rigid annular first socket member having a smooth inner surface and supporting an annular resilient sealing member adapted to engage a fuel tank fill tube, a substantially rigid annular second socket member connected to said body and having a smooth inner surface and supported for axial movement relative to said body between retracted and extended positions, and said first and second socket members having mating and sliding part-spherical surfaces providing for universal tilting movement of said first socket member relative to said second socket member while maintaining said vapor return passage within said socket members.

10. A nozzle assembly as defined in claim 9 wherein said part-spherical surface on said first socket member is interrupted by peripherally spaced slots providing a snap-fit connection of said first socket member onto said second socket member.

11. A nozzle assembly as defined in claim 9 wherein said second socket member has a generally cylindrical said inner surface surrounding said fuel supply spout and defining with said spout an annular said vapor return passage.

12. A nozzle assembly as defined in claim 9 wherein each of said first and second socket members comprises a substantially rigid plastics material.

13. A nozzle assembly as defined in claim 9 and including an annular air impervious flexible cover member connecting said first socket member to said nozzle body to prevent the entrance of dirt and other particles between said mating and sliding part-spherical surfaces.

14. A nozzle assembly as defined in claim 9 and including a diaphragm actuated clutch connected to a pivot pin supporting said control lever connected to operate said fuel control valve and said vapor control valve, and an elongated pin connected to move axially with said second socket member and connected to a crank member to release said clutch when said second socket member is in said extended position.

15. A nozzle assembly as defined in claim 9 wherein said second socket member includes a generally cylindrical portion supported by said nozzle body for axial movement between retracted and extended positions.

* * * * *